US005593334A

United States Patent [19]

Thayer

[11] Patent Number: 5,593,334

[45] Date of Patent: Jan. 14, 1997

[54] WATER WALKERS

[76] Inventor: Thomas E. Thayer, 5204 Roosevelt St., Bethesda, Md. 20814

[21] Appl. No.: 512,977

[22] Filed: Aug. 9, 1995

[51] Int. Cl.[6] ..... B63B 35/83

[52] U.S. Cl. ..... 441/77; 441/76

[58] Field of Search ..... 114/345; 440/101, 440/13, 17, 19; 441/76, 77, 65, 66

[56] References Cited

U.S. PATENT DOCUMENTS

| | | | |
|---|---|---|---|
| 838,986 | 12/1906 | Hannan | 441/76 |
| 974,520 | 11/1910 | Risso | 441/76 |
| 1,013,818 | 1/1912 | Rochat | 441/76 |
| 1,178,165 | 4/1916 | Lupton, Jr. | 114/39.1 |
| 1,248,013 | 11/1917 | Risso | 441/76 |
| 1,275,727 | 8/1918 | Niec | 441/76 |
| 1,413,602 | 4/1922 | Michalski | 441/76 |
| 1,533,023 | 9/1924 | Meredith | 441/76 |
| 2,482,074 | 9/1949 | Stephens | 441/77 |
| 2,694,209 | 11/1954 | Lippincott | 441/77 |
| 2,707,789 | 5/1955 | Brown | 441/77 |
| 2,893,021 | 7/1959 | Lundborg | 441/76 |
| 3,015,830 | 1/1962 | Clark | 441/76 |
| 3,031,696 | 5/1962 | Brabb | 441/77 |
| 3,063,071 | 11/1962 | Van Vorst | 441/77 |
| 3,112,504 | 12/1963 | Carlton | 441/77 |
| 3,121,892 | 2/1964 | Plumlee | 441/76 |
| 3,144,849 | 8/1964 | Maser | 441/76 |
| 3,541,623 | 11/1970 | Duda | 441/76 |
| 3,601,828 | 8/1971 | Fairchild | 441/77 |
| 3,716,881 | 2/1973 | Tilings | 441/77 |
| 3,750,203 | 8/1973 | Ceccato | 441/76 |
| 3,758,898 | 9/1973 | Dougherty | 441/77 |
| 3,808,622 | 5/1974 | Webster | 441/77 |
| 3,952,353 | 4/1976 | Word | 441/76 |
| 4,060,866 | 12/1977 | Robinson | 441/76 |
| 4,117,562 | 10/1978 | Schaumann | 441/77 |
| 4,261,069 | 4/1981 | Schaumann | 441/77 |
| 4,301,562 | 11/1981 | Durr | 441/76 |
| 4,527,984 | 7/1985 | Gilbert | 441/76 |
| 4,578,038 | 3/1986 | Lenten | 440/101 |
| 4,599,072 | 7/1986 | Pollini et al. | 441/65 |
| 4,801,284 | 1/1989 | Lieu | 441/76 |
| 4,804,345 | 2/1989 | Lee | 441/21 |
| 4,808,134 | 2/1989 | Imbeault | 441/70 |
| 5,120,249 | 6/1992 | Fonda | 441/77 |
| 5,236,381 | 8/1993 | Kreogh | 441/77 |
| 5,277,636 | 1/1994 | Seith | 441/77 |

FOREIGN PATENT DOCUMENTS

| | | | |
|---|---|---|---|
| 163091 | 5/1949 | Austria | 441/76 |
| 65897 | 12/1982 | European Pat. Off. | 441/76 |
| 1095907 | 6/1955 | France | 441/76 |
| 1540623 | 7/1924 | Japan . | |

*Primary Examiner*—Edwin L. Swinehart

*Attorney, Agent, or Firm*—Dickstein, Shapiro & Morin, L.L.P.

[57] ABSTRACT

A water walker for walking or skiing over the water. Each walker consists of multiple inflatable tubes attached to one another and with an opening in the middle for inserting the foot. The foot rests on a foot plate supported by a tubular structural support system running horizontally the length of the walker. Propulsion is accomplished by a plurality of pockets made of a flexible membrane joined to the underside of the walker and used either independently or in conjunction with water ski poles or sails. Tabs with grommets or other means are provided at the front, middle and rear for tethering the pair of water walkers together to create a raft. A removable fin may be positioned beneath the foot or at the rear, depending on whether the walkers are used with a sail, as water walkers or as water skiis. The entire apparatus is lightweight and may be transported in a special backpack.

30 Claims, 4 Drawing Sheets

WATER WALKERS

BACKGROUND OF THE INVENTION

1. Field of the Invention

The present invention relates to flotation devices for allowing a person to walk on water, more specifically, to an improved lightweight, inflatable, self-propelled pair of water walkers for water transportation and personal recreation.

2. Description of the Prior Art

The earliest historical reference to water walkers is found in the writings of Merejkowski, who, surveying Leonardo Da Vinci's workshop by moonlight, discovers "pointed boat-shaped skiis for walking over water." Since that time, there has been a continuing interest in developing devices that better enable people to walk on water.

Since issue of the first water walker patent, U.S. Pat. No. 22,457, Dec. 28, 1858, of Rowlands, there have been numerous attempts to solve the inherent problems associated with walking on water. For example, the Rowlands patent reveals a common solution to the spread eagle dilemma (i.e. the tendency to have the pontoons float apart in the water which can cause the user to lose balance) with pivoting tie bars fore and aft which keep the two bouyant pontoons parallel. However, this solution limits freedom of motion and makes turning difficult.

Another poblem concerns the placement of the user's feet with respect to the pontoon's center of bouyancy. U.S. Pat. No. 3,777,324, Dec. 11, 1973, of Jenkins sought to solve this problem by securing the feet on top of the pontoon. However, this arrangement creates instability by placing the user's weight above the pontoon's center of bouyancy. Counteracting instability requires a large keel, such as shown in U.S. Pat. No. 2,651,790, Sep. 15, 1953, of Geiger. However, this feature adds weight and draft to the device.

Another issue with these devices is hydrodynamic design, where form and texture allow smooth and efficient movement over the water. Meyer, U.S. Pat. No. 1,463,330, Jul. 31, 1923, shows an inflatable device which folds accordion-like into a compact package. However, the accordion-like folds result in a high coefficient of drag, making movement over water sluggish.

Other designs simply did not appear workable. For example, U.S. Pat. No. 3,134,114, May 26, 1964, of Stimm, and U.S. Pat. No. 3,750,203, Aug. 7, 1973, of Ceccato, illustrate devices whose width is significant enough to create tremendous stability. However, this width also forces the user to stride with legs wide apart. This causes fatigue and thereby limits the distance one can travel on them.

Quick and easy withdrawal of the foot from a water walker or water ski is also essential for safe use. Some designs clearly failed in this area. Nayes, in U.S. Pat. No. 5,080,621, Jan. 14, 1992, utilizes threaded fasteners to secure a user's shoe to the water walking device. In the event of a fall, the user would have to work underwater holding his or her breath while trying to unscrew two thumbscrews and a wingnut. This could easily turn into a life-threatening situation.

Other means are also helpful in propelling the water skiis across the water. For example, in U.S. Pat. No. 2,577,917, Dec. 11, 1951, Root employs a sail which requires holding with both hands; however, no provisions are described for folding or storing it, should wind conditions negate its use.

Fines, in U.S. Pat. No. 3,027,576, Apr. 3, 1962, discloses a propulsion cup at the bottom of a ski pole. However, he fails to define a means to prevent cup inversion.

Another significant consideration in the commercialization of a water walker product is simplicity. However, the complexity and large number of parts found in U.S. Pat. No. 4,846,743, Jul. 11, 1989, of Ping-chuan make it expensive to manufacture.

Moreover, virtually all of the prior art result in designs that are too bulky, too heavy, or too complex to permit transport in a backpack.

Thus, there is a need in the art to provide an easy to use, stable, compact, and simple water walker design that overcomes all of the aforementioned disadvantages and results in an innovative, safe and versatile recreational and water transportation system.

SUMMARY OF THE INVENTION

Accordingly, in view of the disadvantages delineated above, the general purpose of the present invention is to provide an improved safe, lightweight, easy to use water walker.

To achieve this, the associated embodiments of the invention comprise a plurality of inflatable tubes made of a lightweight inflatable marine material. The tubes intersect at an area of coincidence, as referred to in the drawings. Between the tubes, slightly aft of center, is a foot well to hold the user's foot. A foot plate at the bottom of the foot well provides a platform to carry the user's weight. A tubular structural support system running longitudinally front to rear transfers the user's weight to, and gives rigidity to, the inflatable tubes. Flexible membrane pockets are fixed transversely along the bottom and spaced longitudinally front to rear. These pockets fold against the bottom of the inflatable tubes during forward motion and open to offer resistance when applying a backward force. Poles assist with propulsion and balance. Sails can also be used as an alternate means of propulsion. Tethered together, the pair of water walkers are transformed into a raft. All of the components fit into a special backpack and can thus be transported unencumbered to any destination.

It is, therefore, one object of the present invention to provide an inherently safe flotation device utilizing a hydrodynamically smooth and stable design, allowing quick and easy withdrawal of the feet and permitting either float to carry the user's full weight independently of the other.

A further object of the present invention is to provide a versatile recreational and transportation device capable of being used in a variety of ways: as water walkers, water skiis, sailboat or raft.

A still further object of the present invention is to provide a flotation device with a shallow draft to permit use in shallow water and with a width narrow enough to allow a natural striding motion with the feet passing close to one another.

Yet another object of the present invention is to provide a water walking device that is compact, foldable and easily portable.

An even further object of the present invention is to provide multiple means of propulsion using flexible pockets, poles and sails.

A still further object of the present invention is to provide a water walking device made simply with inexpensive materials and easy to manufacture.

These, together with other objects of the present invention, will become apparent from the subsequent detailed description. For a more comprehensive understanding of the nature and utility as well as advantages gained from this unique invention, reference should be made to the appended claims and accompanying drawings.

A DETAILED DESCRIPTION OF THE INVENTION

Figure 1:
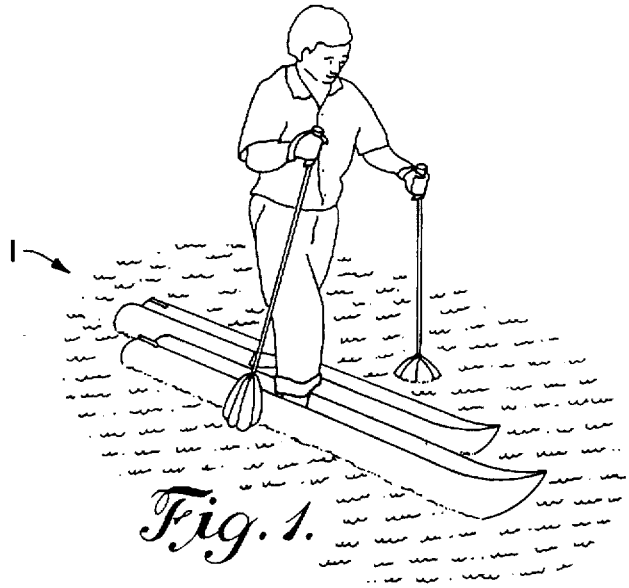
FIG. 1—is a perspective view of a pair of water walkers in use.
Figure 2:
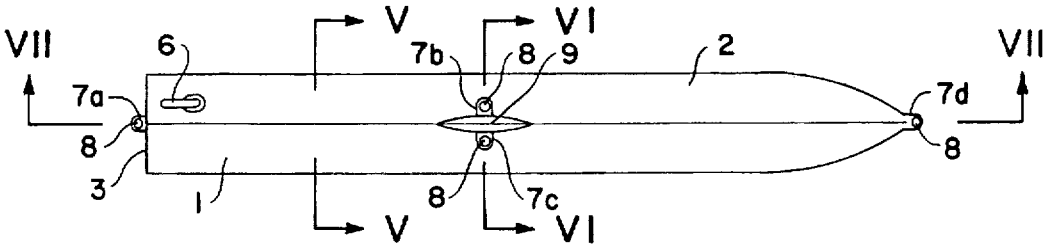
FIG. 2—is a top view of the first embodiment.
Figure 3:
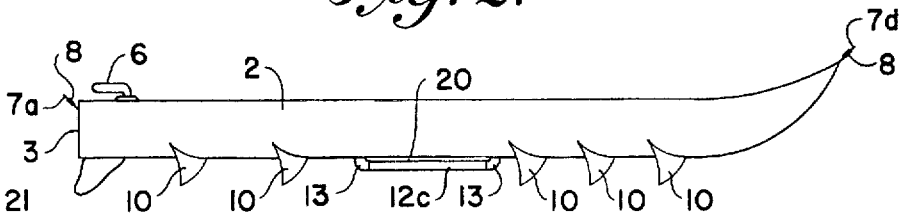
FIG. 3—is a side view of the first embodiment of FIG. 2.
Figure 7:
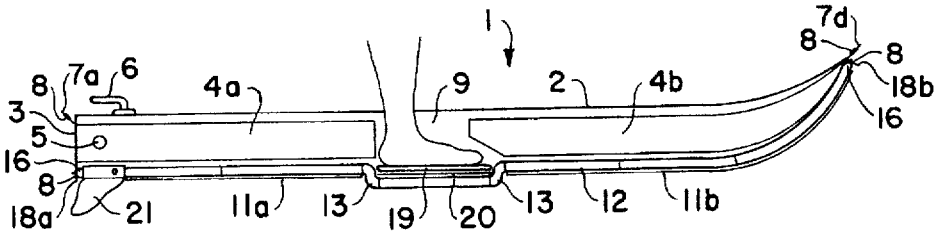
FIG. 7—is a longitudinal cross sectional view taken along lines VII—VII of the first embodiment of FIG. 2.

With reference to drawings, wherein like reference numerals refer to like parts, the first embodiment is presented in FIGS. 1 thru 14. Specifically, FIGS. 1, 2 and 7 show each flotation device comprising two inflatable tubes 2 attached at the area of coincidence 4*a,b* with a hole 5 allowing air to pass between the tubes and requiring only one inflator valve 6 per device. The inflator valve 6 is a type that permits inflation either by mouth or foot pump. The rear panel 3 seals the tubes and is similar in profile to FIG. 5. The inflatable tubes 2 are preferably made of a lightweight vinyl, coated nylon or equivalent inflatable aquatic material.

Each pair of water walkers is designed for a specific weight limit. This means that a person within the weight limit may stand on one foot and remain afloat. This built-in safety feature allows a user to get back to shore on one flotation device if the other should accidentally deflate. Optimal length to width ratios range from 7:1 to 10:1. Ratios within this range keep the length managable yet allow the user to keep his or her feet relatively close together, minimizing fatigue.

Slightly aft of center is an opening or foot well 9 between the tubes 2 to hold the foot within the water walker. Air pressure from the inflatable tubes 2 hold the foot in place. In case of a fall, the foot easily slides out of the foot well 9, an important and necessary safety feature. At the bottom of the foot well 9 is a foot plate 19 which provides a platform to stand on and transfers the user's weight to the tubular structural support system 12*a–f*. The foot plate 19 has rounded corners and edges to minimize abrasion against the inflatable tubes 2, and the membrane 20 which encloses the bottom of the foot well 9. This membrane 20 serves the dual purpose of preventing water from freely flowing within the foot well 9 and of limiting sideways turning of the foot across the foot plate 19. Numerous semi-rigid materials such as marine plywood and plastics are candidates for fabrication of the foot plates 19.

Figure 8:
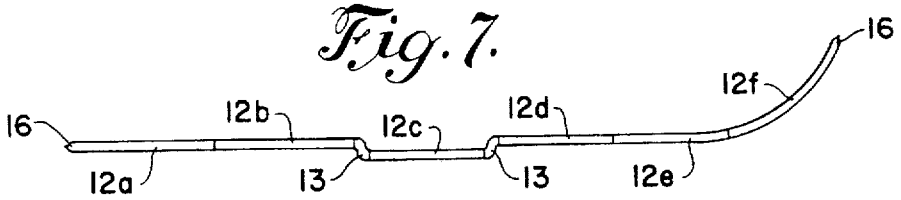
FIG. 8—is a side view of the tubular structural support system 12 of the first and fourth embodiments of FIGS. 2 and 29, respectively.
Figure 10:
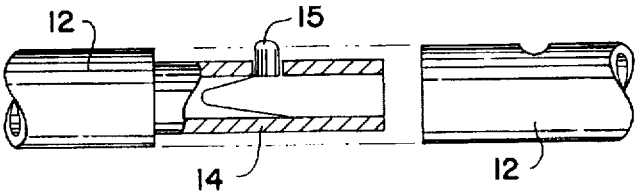
FIG. 10—is a side view detail of the snap button fastening system for assembling the tubular structural support system.
Figure 9:
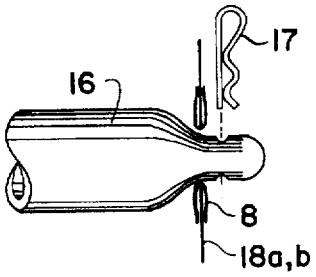
FIG. 9—is a side view detail of the front and rear terminus of the tubular structural support system.
Figure 11:
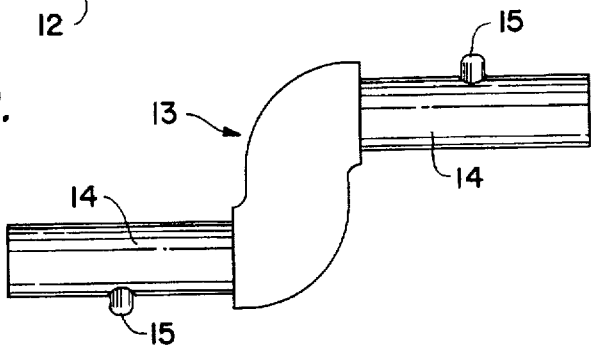
FIG. 11—is a side view detail of an 's' connector.
Figure 12:
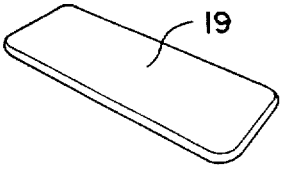
FIG. 12—is a perspective view of the foot plate.

Providing longitudinal rigidity to the inflatable tubes 2 is a tubular structural support system 12*a–f* consisting of several snap-together sections as shown in FIG. 8 and detailed in FIGS. 9, 10 and 11. Each structural section 12*a–f* connects to the adjacent section by depressing a snap button 15 in the inner sleeve 14 and sliding inside until the snap button 15 engages a hole. Two 's' connectors 13, which also have inner sleeves 14 and snap buttons 15, divert the structural system 12*c* beneath the foot plate. The structural system 12*a,b,d,e,f* passes through sleeves 11*a,b*. These sleeves 11*a,b* transfer the user's weight to the buoyant inflatable tubes 2. Terminal sections 12*a* and 12*e* of the tubular structural system have nipple ends 16 which go through grommets 8 in rear tab 18*a* and front tab 18*b* of the inflatable water walkers 1 and are secured with clip pins 17. Material selection for the tubular structural support system 12*a–f*, including 's' connectors 13, must be based upon the ability to withstand the considerable cantilevered bending moment, greatest near the center of the foot plate 19, and the corrosive effects of salt water. Although hardcoated aluminum has proven adequate, other possible choices could include stainless steel, titanium, polycarbonate, fiberglass and carbon composites.

Figure 4:
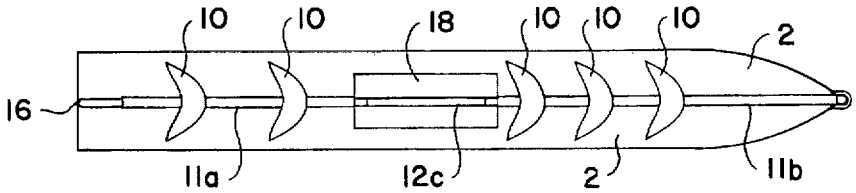
FIG. 4—is a bottom view of the first embodiment of FIG. 2.
Figure 5:
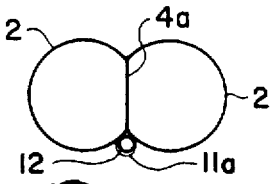
FIG. 5—is a cross sectional view taken along lines V—V of the first embodiment of FIG. 2.
Figure 6:
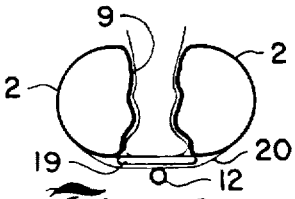
FIG. 6—is a cross sectional view taken along lines VI—VI of the first embodiment of FIG. 2.

FIG. 4 shows flexible membrane pockets 10 spaced along the bottom. When the water walker is sliding forward these pockets 10 fold against the underside of the inflatable tubes 2. As the user pushes backward, water opens the pockets 10 and offers drag resistance to further backward movement.

Thus a shuffling motion (i.e. a walking motion without lifting feet off the water surface) by the user will result in net forward progress. The amount of backsliding before the pockets 10 fully engage is inversely proportional to the total cross sectional area of the pockets 10 and is a function of the front to rear distance of the pockets 10 at the point of attachment at the center and the outer edge: the smaller the distance, the less backsliding.

Figure 13:
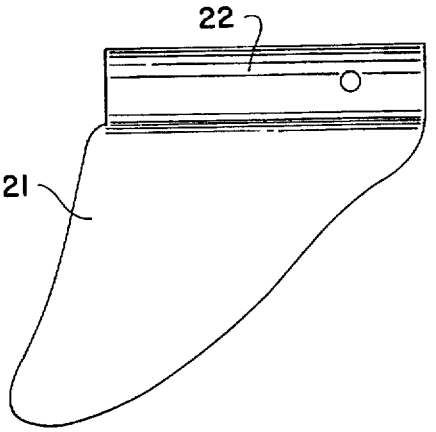
FIG. 13—is a side view of the detachable fin with outer sleeve.
Figure 14:
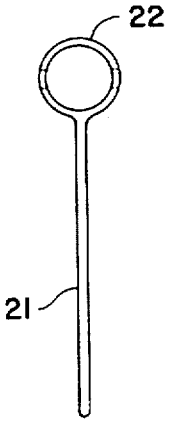
FIG. 14—is a front view of the detachable fin shown in FIG. 13.

A removable fin 21 detailed in FIGS. 13 and 14 may be attached at the aft end or beneath the foot plate 19 by sliding the outer sleeve 22 of the fin over section 12*a* or 12*c* of the structural system 12*a–f*, before the sections are completely joined together, until the fin is engaged by a double snap button (not shown).

Tabs 7*a–d* at the top rear, top middle and top front allow the two water walkers 1 to be tethered together with straps to make a raft.

Figure 15:
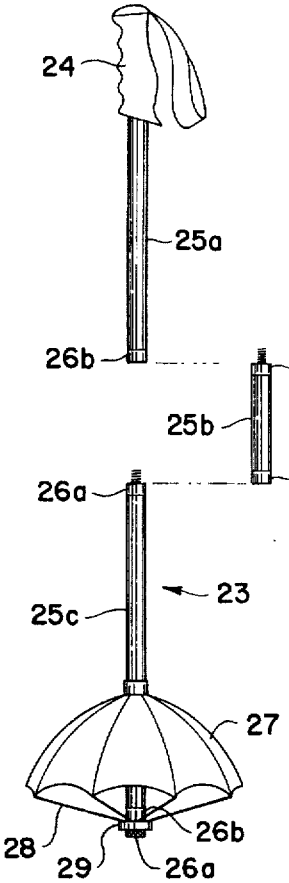
FIG. 15—is an exploded view of the pole used for propulsion.
Figure 16:
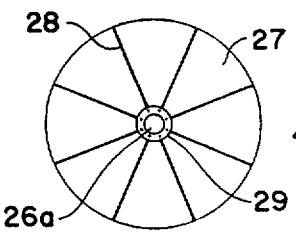
FIG. 16—is a bottom view of the pole showing the flexible cup 27 of FIG. 15.

As illustrated in FIGS. 1, 15 and 16, poles 23 can be used to enhance propulsion and assist balance. These poles 23 consist of an upper shaft 25*a* with a handle 24 and fastener 26*b*. To accomodate users of various heights, a center shaft 25*b* of various lengths with mated fasteners and 26*b* may be inserted between the upper shaft 25*a* and the lower shaft 25*c*. At the bottom end of the lower shaft 25*c* is a flexible collapsible cup 27 which folds against the shaft when the pole 23 is withdrawn from the water. As the pole 23 is pushed down against the water, the cup 27 fully expands and offers resistance against the water. Tensile restraints 28 radially attached from ring 29 to the perimeter of the cup 27 prevent the cup from inverting like an umbrella in a windstorm. Ring 29 is secured to the bottom of the pole shaft 25*c* with mated fastener 26*a*.

Figure 17:
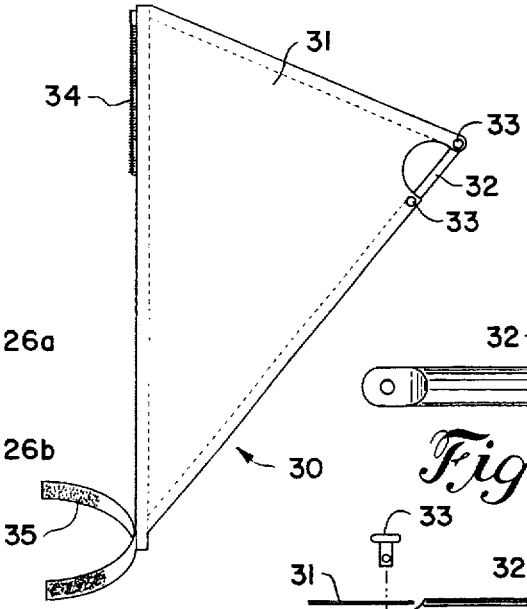
FIG. 17—is a front view of the sail 30.
Figure 18:
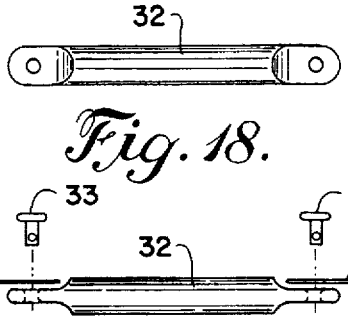
FIG. 18—is a front view of the removable handle 32 for use with sail 30 shown in FIG. 17.
Figure 19:
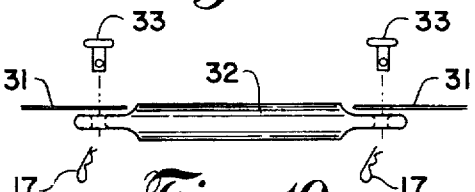
FIG. 19—is a side view of the removable handle 32 depicting the pin attachment to the sail.

An alternate method of propulsion can be achieved with the use of sails 30 as shown in FIG. 17. A set is comprised of two sails 30, mirror images of one another, fabricated of typical sailcloth 31 with zippers 34 that attach to a garment or backpack 36. Located at the lower end of the triangular sails 30 are hook and loop ankle straps commonly referred to as VELCRO® by its registered trademark. Removable handles 32, FIGS. 18 and 19, are fastened to the sailcloth 31 with flanged pins 33 and clip pins 17 or equivalent fasteners. In this manner, the wood or plastic handles 32 may be transferred to various sized sails 30 or from damaged sails to new ones.

Figure 22:
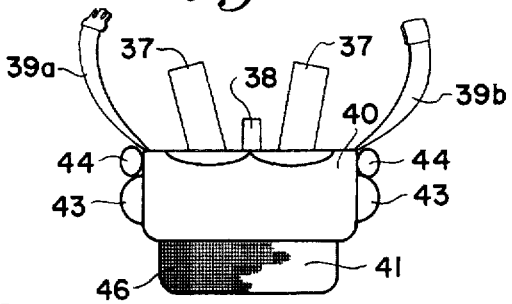
FIG. 22—is a top cross sectional view of the backpack.
Figure 20:
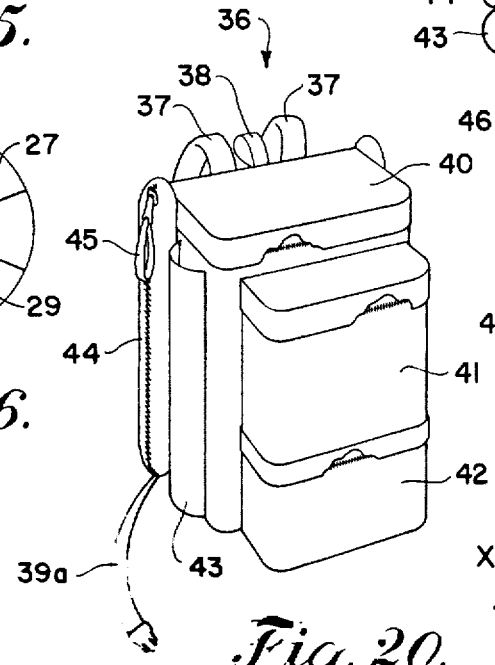
FIG. 20—is a perspective view of the backpack 36 for storing the water walkers 1, poles 23 and sail 30.
Figure 21:
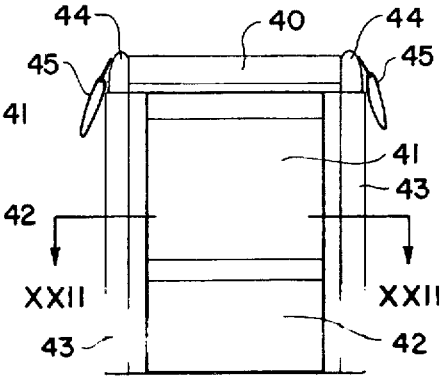
FIG. 21—is a front view of the backpack.

The backpack 36 revealed in FIGS. 20, 21 and 22 is a valuable accessory to the water walkers, capable of carrying all of the components. Like a typical backpack, it has shoulder straps 37, a loop 38 for hanging it up and a waist strap 39*a,b*. A large zippered compartment 40 holds the collapsed inflatable tubes 2, foot plates 19, tubular structural support system 12*a–f* and 's' connectors 13. Another smaller zippered compartment 41 can carry extra clothing, books or lunch. Below that is a yet smaller zippered compartment 42 for holding the fins 21, clip pins 17, straps and a foot pump. Vertical side compartments 43 with VELCRO® fasteners carry the poles 23. The sails 30 are folded within vertically zippered side pockets 44. Large cord or strap loops 45 through the sail pocket zipper handle enable easy deployment of the sails 30. The bottom of each compartment uses either grommets 8 or fabric mesh 46 to facilitate quick water drainage.

Figure 23:
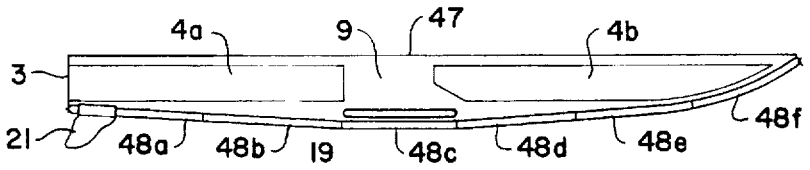
FIG. 23—is a longitudinal cross sectional view of the second embodiment of the invention.
Figure 26:
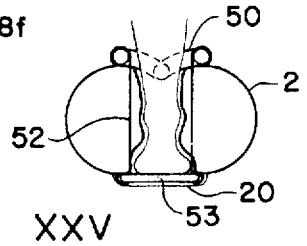
FIG. 26—is a cross sectional view of the third embodiment taken along lines XXVI—XXVI of FIG. 24.
Figure 24:
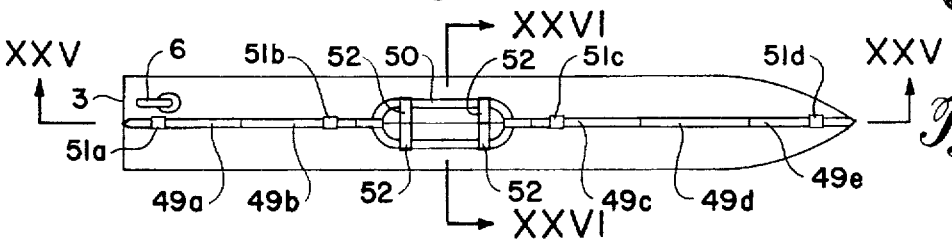
FIG. 24—is a top view of the third embodiment of the invention.
Figure 25:
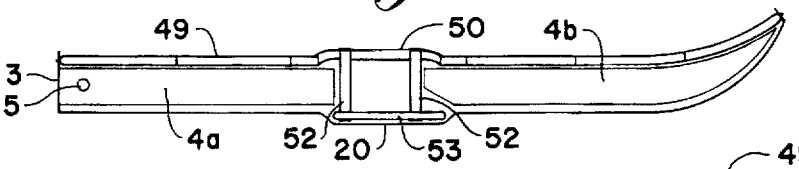
FIG. 25—is a longitudinal cross sectional view of the third embodiment taken along lines XXV—XXV of FIG. 24.
Figure 28:
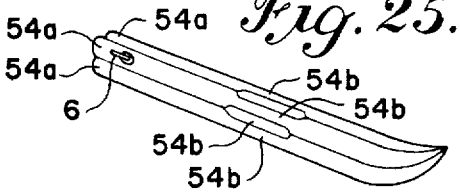
FIG. 28—is a perspective view of the fourth embodiment of the invention.
Figure 27:
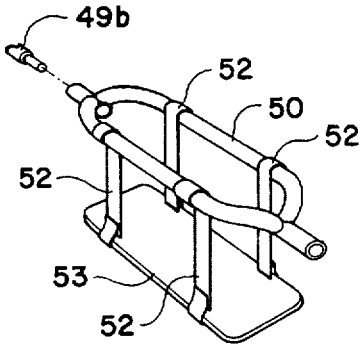
FIG. 27—is a perspective view of the foot plate for the third embodiment shown in FIG. 24.
Figure 29:
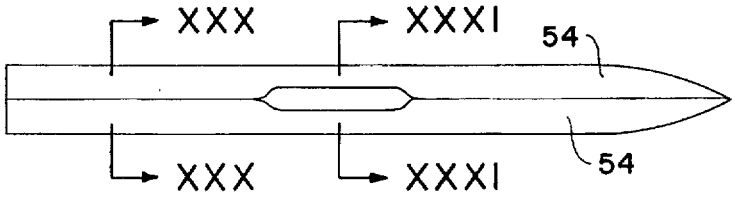
FIG. 29—is a top view of the fourth embodiment.
Figure 30:
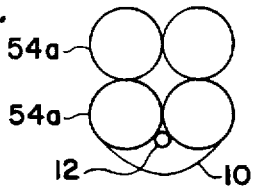
FIG. 30—is a cross sectional view of the fourth embodiment taken along lines XXX—XXX of FIG. 29.
Figure 31:
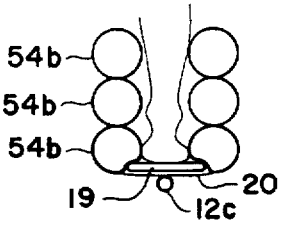
FIG. 31—is a cross sectional view of the fourth embodiment taken along lines XXXI—XXXI of FIG. 29.

The second embodiment, as shown in cross section in FIG. 23, differs from the first embodiment in two distinct ways. First, the top plane of the inflatable tube 47 is flat rather than bowed upward at the front end. Also, the tubular structural support system 48*a,b,d,e,f* slopes gradually downward from the front and rear ends toward the the center section 48*c*, eliminating the need for 's' connectors 13. Both modifications simplify fabrication and thereby reduce manufacturing costs.

FIGS. 24 thru 27 illustrate aspects of the third embodiment of the invention. This embodiment departs from the first embodiment in three ways. First, the tubular structural support system 49*a–e* rests atop the inflatable tubes 2 and is secured with restraining loops 51*a–d*. Second, this necessitates the use of a tubular ring 50 through which to insert a foot. And third, the foot plate 53 hangs from suspension straps 52 attached at the top to the tubular ring 50.

A fourth embodiment shown in FIGS. 28 thru 31, uses a plurality of inflatable tubes 54*a,b*, each tube being significantly smaller in cross sectional diameter than in the other embodiments. This allows the feet to be placed closer together when using the devices, which more closely approximates the motion of cross country skiing.

OPERATION OF THE INVENTION

To assemble the water walkers, the user unrolls the inflatable tubes 2 on a horizontal surface and inserts the foot plate 19 into the foot well 9 and moves it around until it is seated properly. The user then snaps together structural sections 12*a* and 12*b* and slides them into sleeve 11*a* with the nipple end 16 toward the aft end. Then the user snaps together sections 12*d*, 12*e* and 12*f* and slides them into sleeve 11*b* with the nipple end 16 toward the front end. The 's' connectors 13 are snapped into the free ends of sections 12*b* and 12*d*. One end of section 12*c* is snapped into an 's' connector 13. If using the fin 21, the user slides the outer sleeve 22 over section 12*a* or 12*c* until it snaps into place with a double snap button. He or she bends the front and rear ends of the inflatable tubes 2 upward slightly and snaps the other end of section 12*c* into the remaining 's' connector 13. Next, the user pulls front tab 18*b* over the nipple end 16 and secures with a clip pin 17. The user likewise does this with rear tab 18*a*. He or she then inflates the tubes 2 with inflator valve 6, either by mouth or any desirable pump. When the tubes 2 are firm, the water walkers are ready to use. The user then may fasten pole shafts 25*a,b,c* together, selecting the appropriate section 25*b* for his or her height.

FIG. 1 illustrates a person using the water walkers. It is anticipated that there will be provided a variety of sizes of water walkers to carry persons of different weights.

Use commences by placing the pair of walkers 1 in a minimum of 6" of water or 9" if the fin is used. The user inserts one foot into a foot well 9, then shifts weight to that foot while using the poles against the lake bottom for balance. He or she then inserts the other foot into the remaining foot well 9 and proceeds with a sliding motion identical to cross country skiing. The poles 23 will assist with propulsion and balance. When pushing backwards, a small amount of rear motion transpires before the flexible pockets 10 fully expand to offer drag resistance. Turns are accomplished in one of two ways: either by standing still while moving the two poles 23 through the water in opposite directions or by lifting one water walker out of the water and turning it at an angle then lifting the other one and placing it parallel to the first. Each water walker 1 is light enough to lift easily out of the water enabling the user to stand on just one foot. For deploying the sails 30, the user reaches around his or her chest and pulls the loops 45 to unzip the sail pockets 44. The sails 30 will unfurl on their own. He or she then secures the VELCRO( ankle straps 35 and grabs the handles 32.

Remounting after a fall is easily accomplished by pulling the torso over the water walkers and swinging a leg over. From a sitting position the user can reinsert his or her feet.

Accordingly, as expressed within the content of this application, the present invention synergistically resolves all disadvantages of the prior art which have, heretofore, impeded the use and commercialization of water walkers.

Although the foregoing description contemplating construction, materials and usage should be considered as illustrative, it is in no way intended to be limiting and changes or modifications may be made without departing from the scope and spirit of the invention.

What is claimed is:

1. A water walking system comprising:

a pair of flotation devices, each flotation device comprising:

a plurality of inflatable tubes substantially attached to one another along a longitudinal portion of each said tubes;

a foot well located between said plurality of inflatable tubes;

a foot plate at a bottom portion of said foot well for providing a platform for such foot; and a tubular support structure which is connected to said plurality of inflatable tubes through a sleeve located at a bottom portion of said inflatable tubes along a center longitude of said flotation device, in order to provide structural support to said flotation device.

2. The water walking system of claim 1, wherein said plurality of inflatable tubes further comprises holes between adjacent tubes for allowing air to pass between said plurality of tubes.

3. The water walking system of claim 2, wherein a single inflator valve is attached to one of said plurality of inflatable tubes, allowing air to pass through said hole, thus inflating all of tubes through a single valve.

4. The water walking system of claim 1, wherein said inflatable tubes are sufficiently pressurized to hold a user's foot in place when the foot is in the foot well, yet also allow such foot to slide out of said well in case of a fall.

5. The water walking system of claim 1, wherein said foot well is enclosed along a bottom portion by a membrane which prevents water from freely flow inside said foot well and preventing such foot from turning sideways.

6. The water walking system of claim 1, wherein said tubular support structure comprises a plurality of connectable sections wherein each section connects to an adjacent section by a connector.

7. The water walking system of claim 6, wherein two of said sections comprises S-shaped connectors which are adapted to support said foot plate.

8. The water walking system of claim 6, wherein said connector comprises a snap button located on an inner sleeve of a section which is adapted to engage with a hole located on an outer-sleeve of an adjacent portion.

9. The water walking system of claim 1, wherein said sleeve transfers a user's weight to said plurality of tubes.

10. The water walking system of claim 8, wherein said flotation device has two ends, each end having a respective tab whereby said tubular structure is secured at its ends to said tabs.

11. The water walking system of claim 9, wherein said tabs and tubular structure end are secured with clip pins.

12. The water walking system of claim 1, further comprising a plurality of flexible membrane pockets spaced along a bottom portion of said each said flotation device whereby when said flotation device slides forward, said pockets fold against said bottom portion, and when said flotation device is pushed backward, said pockets open and provide resistance to further backward movement.

13. The water walking system of claim 1 further comprising a fin to said flotation device.

14. The water walking system of claim 13, wherein said fin further comprise an outer sleeve which is adapted to slide over said tubular structure and said fin sleeve connects to said tubular support structure through a connector.

15. The water walking system of claim 1, wherein each of said flotation devices further comprises a plurality of tabs enabling said flotation devices to be tethered together through said tabs.

16. The water walking system of claim 1 further comprising a pair of poles, wherein each said pole offers resistance when pushed down against water by such user.

17. The water walking system of claim 16, wherein a bottom end of said pole comprises a flexible collapsible cup which folds against said pole, said cup including a plurality of tensile restraints which radially attach to said pole at one end, and attach to an interior periphery of said cup, at an opposite end, in order to prevent said cup from inverting when said pole is pushed down against water.

18. The water walking system of claim 1 further comprising a set of sails wherein one of said sails is a mirror image of the other, and said set of sails is adapted to be held by a user's hands at one end and connected to a user's backpack at another end.

19. The water walking system of claim 18, wherein said sail includes a removable handle, fastened to said sail with flanged pins and clip pins so that said sail can be positioned by movement of a user's arms.

20. The water walking system of claim 18, wherein said backpack comprises a zippered compartment which is adapted to contain said water walking system and a pair of vertical side compartments that contains said sails in a folded position, whereby each said sail is attached to said backpack in order to be deployed when said sail is unfolded outwardly from said side pockets.

21. The water walking system of claim 1, wherein each of said flotation device has a top surface, said top surface being curved upward at a front end of said flotation device.

22. The water walking system of claim 1, wherein each of said flotation device has a top surface, whose longitudinal cross-section appears substantially linear.

23. The water walking system of claim 1, wherein each of said flotation device has a bottom sleeve which slopes gradually downward relative to said plurality of flexible tubes and parallel to said tubular support structure from front and rear ends toward a center bottom portion.

24. A water walking system comprising:

a pair of flotation devices, each flotation device comprising:

a plurality of inflatable tubes substantially attached to one another along a longitudinal portion of each said tubes;

a foot well located between said plurality of inflatable tubes;

a foot plate at a bottom portion of said foot well for providing a platform for such foot; and a tubular support structure which is attached to a top surface of said flotation device along a center longitude of said flotation device in order to provide structural support to said flotation device.

25. The water walking system of claim 24, wherein said foot well further comprises a tubular ring for defining an opening to said foot well and a plurality of suspension straps each attached at one end to said tubular ring and at an opposite end to said foot plate in order to support and suspend said foot plate above a bottom surface of said flotation device.

26. A water walking system comprising:

a pair of flotation devices, each flotation device comprising:

a plurality of inflatable tubes substantially attached to one another along a longitudinal portion of each said tubes;

a foot well located between said plurality of inflatable tubes;

a foot plate at a bottom portion of said foot well for providing a platform for such foot; and a tubular support means, which is connected to said plurality of inflatable tubes through a sleeve located at a bottom portion of said inflatable tubes along a center longitude of said flotation device, for providing structural support to said flotation device.

27. A method of assembly of water walkers and using same comprising the steps of:

inserting a foot plate into a foot well located between a plurality of inflatable tubes substantially attached to one another along a longitudinal portion of each said tubes;

inserting a tubular support structure through a sleeve located at a bottom portion of said inflatable tubes along a center longitude of said flotation device;

inflating said plurality of inflatable tubes;

inserting a foot into the foot well;

resting said foot on said foot plate;

sliding said foot on water.

28. The method of assembly of water walkers and using same of claim 27 further comprising the step of:

sliding a fin over said tubular support structure.

29. The method of assembly of water walkers and using same of claim 27 wherein the inflating step includes forcing air through a single inflator valve.

30. The method of claim 27 further comprising the step of:

putting poles into said water to assist with propulsion and balance.

* * * * *